United States Patent [19]

Windecker

[11] Patent Number: 4,576,010

[45] Date of Patent: Mar. 18, 1986

[54] CRYOGENIC REFRIGERATION CONTROL SYSTEM

[75] Inventor: Robert J. Windecker, Palm Beach, Fla.

[73] Assignee: Nhy-Temp, Inc., West Palm Beach, Fla.

[21] Appl. No.: 543,059

[22] Filed: Oct. 18, 1983

[51] Int. Cl.[4] ..... F25D 17/02

[52] U.S. Cl. ..... 62/64; 62/161; 62/239; 62/514 R

[58] Field of Search ..... 62/239, 161, 162, 384, 62/64, 514 R

[56] References Cited

U.S. PATENT DOCUMENTS

| | | | |
|---|---|---|---|
| 2,479,840 | 8/1949 | Johnson et al. | 62/239 |
| 2,479,867 | 8/1949 | Rosebaugh | 62/239 |
| 3,127,755 | 4/1964 | Hemery | 62/385 |
| 3,269,133 | 8/1969 | Dixon | 62/51 |
| 3,287,925 | 11/1966 | Kane et al. | 62/239 |
| 3,385,073 | 5/1968 | Snelling | 62/45 |
| 4,058,384 | 11/1977 | Keefe | 62/457 |
| 4,060,400 | 11/1977 | Williams | 62/239 |
| 4,373,344 | 2/1983 | Hinn | 62/388 |
| 4,399,658 | 8/1983 | Nielsen | 62/388 |

*Primary Examiner*—Ronald C. Capossela
*Attorney, Agent, or Firm*—Wendell Coffee; Montgomery W. Smith

[57] ABSTRACT

Three tanks containing cryogenic fluid coolant are mounted inside the insulated compartment of a refrigeration container. A control system releases coolant into the compartment responsive to changes in the compartment temperature relative to maximum and minimum temperatures. When the compartment temperature is below the minimum temperature, no cooling of the compartment is desired, and the controller vents all excess boil off vapor outside the compartment. When the compartment temperature is above the maximum temperature, substantial cooling is required, and the controller releases vaporized coolant liquid into the compartment. When the compartment temperature is between the maximum and minimum temperatures, some minimal cooling is needed, and the controller flows the excess boil off vapor into the compartment instead of venting it outside. The coolant is released into the compartment through a venturi to circulate the compartment gases. Special valves and venturi permit operation of the system for more than a year without recharging a standard 12 volt DC battery.

9 Claims, 2 Drawing Figures

CRYOGENIC REFRIGERATION CONTROL SYSTEM

CROSS REFERENCE TO RELATED APPLICATIONS

None.

BACKGROUND OF THE INVENTION (1) Field of the Invention

This invention relates to containers for goods that are cooled by releasing cryogenic fluids thereinto, and more particularly to refrigeration control systems for such containers.

(2) Description of the Prior Art

Containers for shipping and storing fresh produce and frozen goods were cooled by the release of cryogenic fluids before my invention. In some cases, this "cryogenic cooling" supplemented mechanical/compressor-type cooling, while other systems were devised that used "cryogenic cooling" alone.

Before filing this application a search was made in the U.S. Patent and Trademark Office. That search revealed the following U.S. patents:

| | |
|---|---|
| JOHNSON ET AL | 2,479,840 |
| ROSEBAUGH | 2,479,867 |
| DIXON | 3,269,133 |
| KANE ET AL | 3,287,925 |
| SNELLING | 3,385,073 |
| WILLIAMS | 4,060,400 |

These patents are deemed pertinent because the applicant believes the Examiner would regard anything revealed by the search to be pertinent to the examination of this application.

Although the refrigeration systems for prior art containers functioned satisfactorily under some conditions, certain inefficiencies were inherent in their design. Boil off gases result from heat transfer into the tank or bottle holding the cryogenic fluid coolant. Greater amounts of boil off gas are produced with tanks mounted outside refrigeration compartments. These designs usually vented the boil off gases outside continuously. This was extremely wasteful, inasmuch as this extremely cold gas could be used to cool the container.

Other prior art systems continuously vented the boil off gases into the compartment. This design sometimes produced too much cooling of the container.

The power requirements of the prior art refrigeration systems presented another problem. Most required repeated recharging of batteries or connections to external power sources during storage or shipment. These power problems are exacerbated when containers are used in holds of ships where external power sources are inconvenient or unavailable.

SUMMARY OF THE INVENTION (1) New Function and Surprising Results

I have invented a control system for a cryogenically cooled storage or transport container that solves many of the problems noted above by accomplishing the unusual and surprising results of efficiently controlling the release of cryogenic vapor and liquid into the container for cooling and decreasing power and servicing requirements during storage and transport with my novel combination of conduits, tanks, valves, venturi and the like.

It will be understood that although the description herein relates primarily to transport containers, my invention may also be advantageously used with storage containers because of the reduced servicing requirements and more efficient use of the liquid nitrogen. Additionally, the term "cryogenic fluids" herein refers to compounds or elements that have a boiling point lower than −70° F. and include, but are not limited to, nitrogen, helium, argon, carbon dioxide, air, oxygen, and the like. Of course the type of cryogenic fluid used as coolant will depend upon many factors including the goods being transported or stored and the effect of such cryogenic fluids thereupon.

My invention discriminates between those instances where it is desirable to vent the boil off gases outside the container to prevent overcooling and those instances where the boil off gases may be flowed into the container as beneficial coolant. My invention also responds to those instances where cooling capacity greater than that abailable with the boil off gas is required. To accomplish these results, my invention employs a controller using two set points. The controller is connected to a temperature sensor, and a control point of the controller varies with respect to the two setpoints as the container temperature varies.

A lower setpoint is preset to correspond to a minimum temperature of the container wherein no cooling is desired. The upper setpoint of the controller is preset to correspond to a maximum temperature of the container wherein the cooling provided by the boil off gas will not be sufficient. For example, when low ambient temperatures outside the container result in reduced heat transfer into the compartment, the compartment temperature will decrease to below the minimum temperature, which will result in venting of the boil off gases to outside the container until the container temperature has risen above the minimum temperature. As the container temperature rises to above the minimum temperature and below the maximum temperature, boil off gases from the cryogenic fluid will be flowed into the container for cooling. In higher ambient temperatures, where the heat transfer rate into the container is relatively great, the container temperature will rise above the maximum temperature, thereby causing the flow of liquid nitrogen from the cryogenic tanks through a vaporization section into the compartment for increased cooling. Therefore, my invention efficiently uses the liquid nitrogen only when necessary, and efficiently uses the boil off gases to provide minimal cooling without over-cooling.

My invention uses minimal power for the functioning of the control system and circulation of the gases in the container. The solenoid valves used with my invention use electrical power for only the very small time (milliseconds) needed to switch from the open to the closed positions and vice versa. Standard solenoid valves require continuous application of power while holding the valve in one of the positions, typically the open position.

Another source of power waste is the requirement of circulation of the gases within the container to achieve even cooling. My invention uses a venturi instead of electrically operated fans to accomplish this circulation. The decrease in power usage is so substantial that I am able to employ a standard 12-volt DC battery for operating periods of over one year without recharging.

Thus it may be seen that the function of the total combination far exceeds the sum of the functions of the individual elements such as conduits, valves, tanks, etc.

(2) Objects of this Invention

An object of this invention is to refrigerate goods within a container.

Further objects are to achieve the above with a device that is sturdy, compact, durable, lightweight, simple, safe, efficient, versatile, ecologically compatible, energy conserving, and reliable, yet inexpensive and easy to manufacture, install, adjust, operate and maintain.

Other objects are to achieve the above with a method that is versatile, ecologically compatible, energy conserving, rapid, efficient, and inexpensive, and does not require highly skilled people to install, adjust, operate, and maintain.

The specific nature of the invention, as well as other objects, uses, and advantages thereof, will clearly appear from the following description and from the accompanying drawing, the different views of which are not scale drawings.

DESCRIPTION OF THE PREFERRED EMBODIMENT

Figure 1:
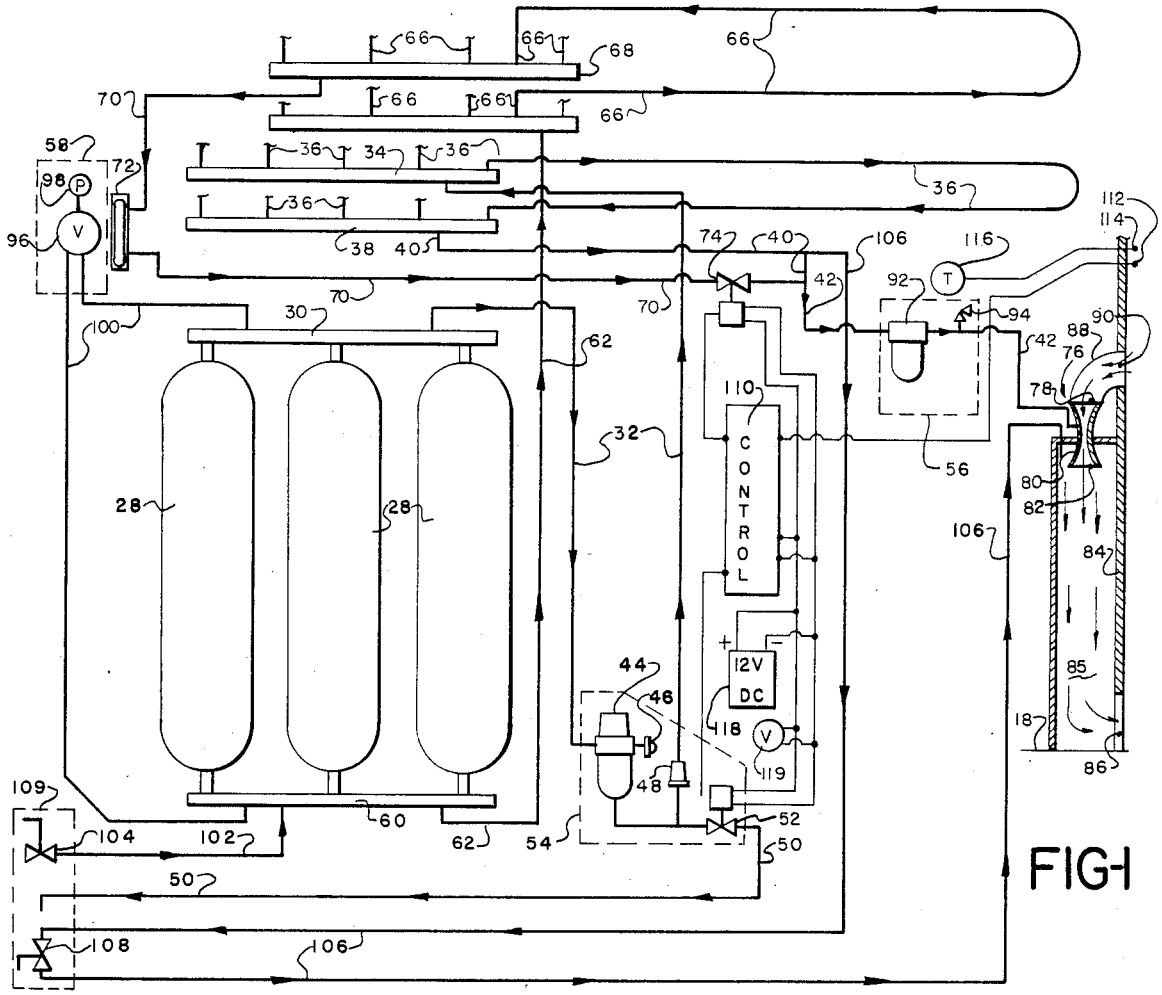
FIG. 1 is a schematic diagram of the refrigeration control system.
Figure 2:
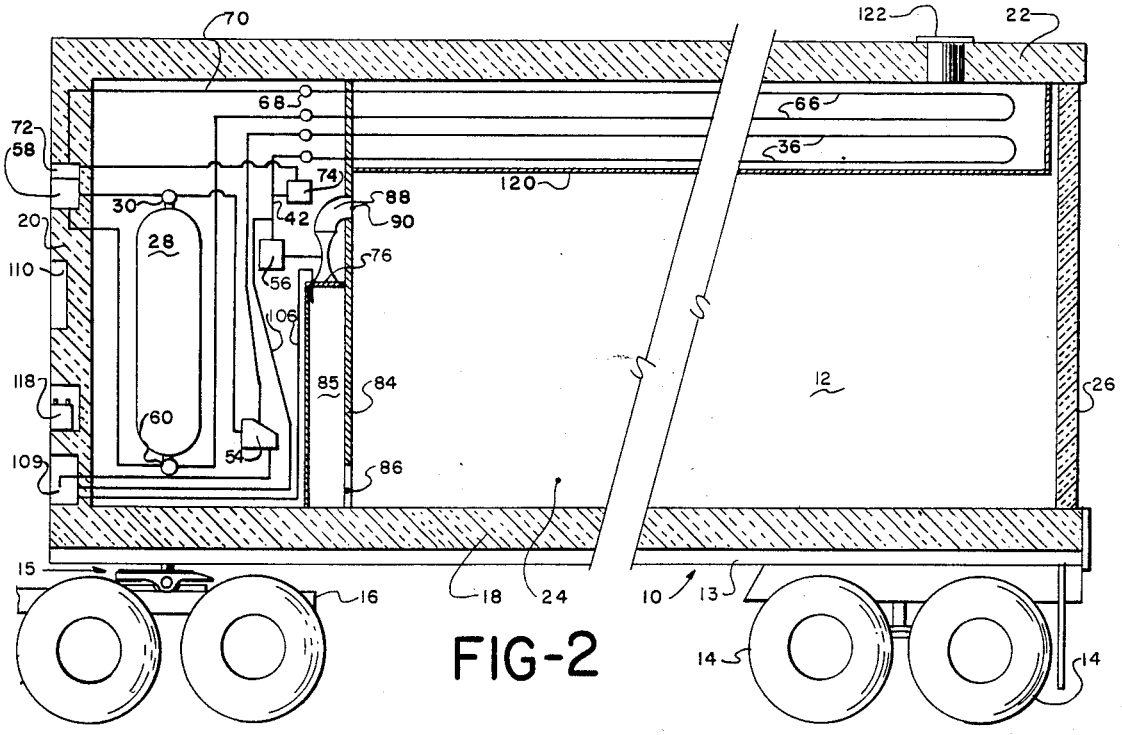
FIG. 2 is a somewhat schematic side sectional view of a transport container with the control system installed therein.

Referring to FIG. 2, refrigerated transport container 10 includes insulated compartment 12 with frame 13 and wheels 14 thereunder. The container is connected at fifth wheel 15 to transport means in the form of tractor 16 (partially shown) for transporting the container 10.

The compartment 12 is formed by compartment floor 18, front wall 20, roof 22, side walls 24, and rear doors 26. The floor, walls, roof and doors are heavily insulated so that minimal heat transfer occurs between the ambient atmosphere and the space within the compartment.

The compartment 12 is refrigerated by the release of coolant vapor obtained from cryogenic fluid stored in cryogenic tanks 28 within the compartment 12. Nitrogen is the preferred cryogenic fluid for many applications, especially those involving fresh produce because nitrogen is inert and less expensive than most other cryogenic fluids. Therefore, although the subsequent discussion of my invention will be in connection with nitrogen as the cryogenic fluid, it will be understood that this embodiment is equally applicable to other cryogenic fluids and that those with ordinary skill in the art will be able to adapt this described embodiment to the use of such other cryogenic fluids.

Because the temperature inside the compartment 12 will usually be lower than the ambient temperature outside the compartment, the tanks 28 are preferably mounted inside the compartment 12 to reduce heat transfer into the liquid nitrogen in the tanks. I prefer to employ three or more tanks spaced along the front wall 20 to occupy the least usable compartment space with the tanks and control system.

The nitrogen, or cryogenic fluid, coolant in the tanks 28 is in the liquid and vapor states, hereinafter referred to as coolant liquid and coolant vapor respectively. A vapor conduit is connected at a tank end thereof through tops of the tanks 28 to the coolant vapor, and a liquid conduit is connected at a tank end thereof through bottoms of the tanks to the coolant liquid. Outlet ends of the vapor conduit and the liquid conduit are fluidly connected to inside the compartment through a distributor.

The vapor conduit includes vapor header 30 at the vapor conduit tank end connecting the tops of the tanks 28, vapor supply line 32 connected at one end to the vapor header 30 and at an opposite end to vapor supply manifold 34, five vapor exchange lines 36 connected at one end to the vapor supply manifold 34 and at opposite ends to the vapor return manifold 38, and vapor return line 40 connected at one end to the vapor return manifold 38 and at an opposite end to an end of distributor conduit 42 of the distributor.

Pressure regulator 44 is in the vapor supply line 32 and maintains a maximum operating pressure in the tanks 28. The tanks 28 must be pressurized to flow liquid through the liquid conduit. The maximum pressure is preferably 22 PSIG to comply with the Department of Transportation regulations for transport containers. The regulator 44 incorporates a rupture disk 46 designed to burst at 100 PSIG to avoid overstressing the tanks 28. I prefer to use tanks rated at 400 PSIG capacity, providing a safety factor of four. Flow valve 48 is in the vapor supply line 32 between the regulator and the vapor supply manifold 34.

Vent conduit 50 is connected to the vapor supply line 32 through vent valve 52. The vent valve 52 is between the pressure regulator 44 and the flow valve 48. An end of the vent conduit 50 opposite the connections to the vapor supply line 32 extends to outside the compartment through the front wall 20. The flow valve 48 opens when the pressure in the vapor supply line 32 between the regulator and the flow valve exceeds one PSIG. Therefore, when the vent valve 52 is open, coolant vapor flowing from the tanks 28 through the vapor supply line will not flow through the flow valve 48, but instead will flow through the vent valve 52 to the atmosphere.

However, if the vent valve 52 is closed, pressure in the vapor supply line 32 between the flow valve 48 and the pressure regulator 44 will increase until the flow valve 48 opens, flowing the vapor through the vapor supply line 32 to the vapor supply manifold 34. The flow valve 48 and vent conduit 50, in combination with the fluid connection of the vent valve 52 to the vapor supply line 32, form a first valve assembly having a vent position when the vent valve 52 is open such that the coolant vapor is vented from the tanks to the atmosphere as described above and having a flow position when the vent valve is closed and the coolant vapor flows from the tanks through the flow valve 48 to inside the compartment.

The liquid conduit includes liquid header 60 at the tank end of the liquid conduit connecting the bottoms of the tanks 28, liquid supply line 62 connected at one end to the liquid header 60 and at an opposite end to liquid supply manifold 64, five liquid vaporizer lines 66 connected at one end to the liquid supply manifold 64 and at an opposite end to liquid return manifold 68, and liquid return line 70 connected at one end to the liquid return manifold 68 and at an opposite end to the distributor conduit 42.

Flow meter 72 is in the liquid return line 70 and is preferably mounted in the front wall 20 for visual access by persons outside the compartment 12. The flow meter 72 provides a visual reading of the flow rate of coolant liquid vaporized in the vaporizer line 66 and limits the flow of such vaporized coolant liquid to a preferred preset limit of 200 cubic feet per hour (cfh). Experience has shown that a flow rate of more than 200 cfh exceeds reasonable requirements for efficiently cooling fresh vegetation in the compartment. However, if additional cooling capacity is required, such as for frozen goods, this maximum vaporized coolant liquid flow rate could be adjusted.

Releasing valve 74 is located in the liquid return line 70 between the flow meter 72 and the distributor conduit 42. When the releasing valve is closed, the vapor and liquid coolant reach equilibrium at the tank pressure. While the releasing valve 74 remains closed, the vapor-liquid equilibrium in the liquid conduit will prevent flow of coolant liquid from the tanks 28.

However, when the releasing valve 74 is open, the pressurized vaporized coolant liquid in the liquid conduit will be released into the compartment through the distributor. The coolant liquid will flow from the tanks through the liquid conduit into the liquid vaporizer line 66, where heat exchange with the compartment gases will vaporize the coolant liquid. The releasing valve 74 forms a second valve assembly having an open position when the releasing valve 74 is open and coolant liquid is released into the compartment through liquid conduit and having a closed position when the releasing valve 74 is closed so that flow of coolant liquid does not substantially occur through the liquid conduit.

The distributor includes the distributor conduit 42 and venturi 76. The distributor conduit 42 is connected to an outlet end of the vapor conduit in the form of the opposite end of the vapor return line 40, and to an outlet end of the liquid conduit in the form of the opposite end of the liquid return line 70. The venturi 76 includes a venturi 78, a throat 80, and an outlet 82. The venturi outlet and inlet are fluidly connected to the gases within the compartment 12. The distributor conduit 42 is connected to the venturi throat. Therefore, the release of the pressurized coolant vapor from the liquid or vapor conduits through the distribution conduit 42 into the throat 80 and out the venturi outlet 82 will induce or impel the gases within the compartment 12 to flow into the venturi inlet 78 through the throat 80 and out of the venturi outlet 82. The venturi functions as a circulation device to replace electrically powered circulation fans.

However, to make the circulation more efficient, the distributor also preferably includes partition 84 segregating the tanks from a portion of the compartment, plenum 85 fluidly connecting the venturi outlet 82 with the gases within the compartment 12 through ports 86 in the partition proximate the compartment floor 18, and duct 88 fluidly connecting the venturi inlet 78 with hole 90 in the partition 84 spaced above the compartment floor 18. The partition also protects the refrigeration system from the goods in the compartment.

I prefer to use a venturi specially designed to produce a flow rate of 20 cubic feet of compartment gases for each cubic foot of coolant gas released therethrough. This special venturi is made by Vortec Corporation, and is referred to in the literature as a "model 913 TRANSVECTOR". TRANSVECTOR is a trademark of the Vortec Corporation. This venturi also solves icing problems inherent in flowing moist gases at high velocities through a venturi-type constriction.

For safety and reliability, I prefer to use filter 92 and relief valve 94 in the distributor conduit. Liquid level gauge 96 and pressure gauge 98 are preferably mounted in the front wall 20 for access by persons outside the compartment to determine the level in the tanks 28 and the tank operating pressure. The gauges 96 and 98 are in gauge line 100 connecting the vapor header 30 and the liquid header 60.

Coolant fill line 102 is connected at one end to the liquid header 60 and at the other end to fill valve 104 conveniently mounted in the front wall 20. The fill valve 104 provides a means for connecting the tanks 28 to a source of liquid nitrogen or other cryogenic fluid coolant.

Bypass line 106 is fluidly connected at pme emd to the vapor conduit at the vapor return line 40 and at the other end to the plenum 85 outside the venturi 76. Bypass valve 108 is in the bypass line 106 and is mounted for convenient manual operation in the front wall 20. The operation and function of the bypass line 106 and valve 108 will be described in detail later.

Controller 110 is preferably mounted in the front wall 20 for convenient access by a person outside the compartment. The controller is connected by wires to the vent valve 52 and the releasing valve 74. The vent valve and releasing valve are electrically controlled and actuated solenoid valves that may be switched from open to closed and vice versa by the application of an electric current.

I prefer to use a special solenoid to control the valve called a MAGNALATCH solenoid. The MAGNALATCH solenoid operated valve is manufactured by Skinner Valve, a division of Honeywell Corporation, and is designated in the literature as part No. 2LF2HB4127, ½ inch, "LANCER" solenoid with "MAGNALATCH". The words MAGNALATCH and LANCER are trademarks of the Skinner Valve Company.

Standard solenoid valves have a normally open or normally closed position, and require continuous application of electric current to maintain a position opposed to the normal position. For example, a normally open solenoid valve would require the continuous application of current to the solenoid to keep the valve closed. However, the MAGNALATCH solenoid requires current only for the few milliseconds needed to change the valve position. Therefore, the use of this special solenoid greatly reduces the electrical power requirements of the valve operation.

The controller 110 is connected by wires to temperature sensor 112 located inside the compartment 12 in a position to sense the temperature of gases within the compartment, hereinafter called the compartment temperature. I prefer to also provide a temperature sensor 114 with the sensor 112, connected by wires to thermometer 116 conveniently mounted in the front wall 20 for reading by a person outside the compartment 12.

The controller 110, vent valve 52, and releasing valve 74 are each connected by wires to DC battery 118 conveniently mounted in the front wall 20 as a source of power. Due to the power savings occasioned by the use of the venturi and the MAGNALATCH valves, experience has shown that operating periods of an excess of one year are obtainable without recharging the battery 118. I prefer to provide a volt meter 119 conveniently mounted in the front wall 20 and electrically connected to the battery 118 to allow an operator of the system to determine the charge of the battery. For the purposes of clarity in the drawings, some of the elements have been grouped and are schematically shown by boxes in FIG.

2. It will be understood that FIG. 2 shows the approximate locations of major elements of the preferred embodiment, and is not to scale.

The groups shown in FIG. 2 are described below. Vent group 54 includes the pressure regulator 44, the rupture disk 46 on the regulator 44, the flow valve 48 and the vent valve 52, also described as the first valve assembly. Distribution group 56 includes the filter 92 and the relief valve 94. Gauge group 58 includes the liquid level gauge 96 and the pressure gauge 98. Vent-fill group 109 includes the vill valve 104, the vent conduit 50 outlet and the bypass valve 108. The flow meter 72 and the releasing valve 74 are also shown schematically in FIG. 2 with boxes.

The controller has a preset lower setpoint, a preset upper setpoint, and a control point that varies with respect to the setpoints responsive to changes in the sensor input corresponding to variance of the compartment temperature. It may be seen that as the compartment temperature varies, the electrical sensor input from the temperature sensor 112 to the controller 110 will change, thereby varying the control point. The setpoints are preset to correspond to a selected minimum temperature and a selected maximum temperature.

The minimum temperature is selected such that if the compartment temperature is at the minimum temperature, no cooling of the compartment is desired. The maximum temperature is selected as that temperature at which cooling of the compartment by the flow of coolant vapor from the top of the tanks is insufficient to cool the compartment, and release of coolant liquid through the bottom of the tanks 28 is required to provide adequate cooling capacity. For fresh produce, the maximum and minimum temperatures have typically been 32° F. for the minimum temperature and 35°37° F. for the maximum temperature. Of course, the values of the minimum and maximum temperatures, and their separation, are dependent upon the type of products being refrigerated, the ambient conditions, and the cryogenic fluid coolant being used. The produce will be damaged by temperatures below the minimum. Excessive deterioration occurs when the temperature exceed the maximum.

The lower setpoint on the controller is set to correspond to the minimum temperature and the upper setpoint on the controller is set to correspond to the maximum temperature. For example, when the compartment temperature is at the minimum temperature, the sensor input from the temperature sensor 112 should move the control point to be even with the lower setpoint. Likewise when the compartment temperature is at the maximum temperature, the control point should be even with the upper setpoint.

The operation of the control system may be seen to occur as follows: The minimum and maximum temperatures are selected according to the criteria outlined above, and the setpoints on the controller corresponding to the maximum and minimum temperatures are preset. The compartment temperature is then sensed and compared with minimum and maximum temperatures. The control point of the controller varied responsive t changes in the compartment temperature.

When the compartment temperature is below the minimum temperature, the coolant vapor will be vented through the top of the tanks to outside the compartment responsive to moving the control point with sensor input below the lower setpoint, causing the controller to electrically activate the vent valve to open so that the first valve assembly is in the vent position.

When the compartment temperature is between the maximum and minimum temperatures, the coolant vapor will be flowed into the compartment responsive to varying the control point with sensor input between the upper and lower setpoints, causing the controller to change the vent valve to closed so that the first valve assembly is in the flow position and causing the controller to activate the releasing valve to closed so that the second valve assembly is in the closed position to prevent substantial coolant liquid flow through the liquid conduit.

When the compartment temperature is above the maximum temperature, the coolant liquid will flow through the bottom of the tank into the compartment responsive to varying the control point above the upper setpoint with sensor input causing the controller to activate the releasing valve to open, so that the second valve assembly is in the open position, to release vaporized coolant liquid into the compartment.

As previously described, the venturi circulates gases within the compartment by discharging the coolant vapor or vaporized coolant liquid into the venturi and out the venturi outlet into the compartment thereby inducing flow of gases from the compartment into the venturi inlet through the venturi and out the venturi outlet into the compartment, when the compartment temperature is above the minimum temperature.

The vapor exchanger line 36 and liquid vaporizer line 66 are positioned immediately below the roof 22. This positioning of the lines accomplishes the greatest heat transfer because the warmer gases within the compartment will tend rise to the roof. Therefore, the cold cryogenic fluid flowing through the lines will absorb heat from the gases, thereby further cooling the interior. The transferred heat also vaporizes the coolant liquid in the liquid vaporizer line.

For transport containers used in transporting fresh vegetation produce, the vaporizer and exchanger lines 36 and 66 are spaced between the roof 22 and ceiling pan 120. Chilled water is flowed through hydrocooling duct 122 onto the pan 120 below the roof and sprinkled through perforations in the pan over just loaded fresh vegetation. While the chilled water is further chilled by the coolant in the vaporizer and exchanger lines. The chilled water floods the fresh produce, quickly chilling it, and is drained from the floor 18.

The hydrocooling procedure just described is most advantageously performed in conjunction with purging of the atmosphere from the container and compartment by the injection of the nitrogen cryogenic vapor. During the hydrocooling, liquid nitrogen is flowed into the tanks 28 through the fill valve 104 and the fill line 102. Because supplies of liquid nitrogen are most often transported at ambient temperatures and very high pressures, depressurization will cause vaporization of significant amounts of the liquid nitrogen as it flows into the tanks 28. In practice, this vaporization has been about $\frac{1}{3}$ of the liquid nitrogen flowed into the tanks.

The venturi 76 used for normal cooling operations is of insufficient capacity to handle this high coolant vapor flow rate. Therefore, during filling, hydrocooling, and purging operations, the bypass valve 108 in the bypass line 106 is opened to directly release, flow or inject the excess nitrogen vapor into the plenum 85 and into the compartment 12. The very high vapor flow rate quickly purges the atmosphere from the compartment.

Therefore, the combination of the filling and purging operations during hydrocooling accomplishes the unusual and surprising results of quickly chilling goods in the container while quickly replacing the atmosphere in the container with the inert cryogenic fluid vapor and filling the cryogenic tanks for normal operations. It should be apparent that if the filling operation were accomplished separate from the purging operation, the excess coolant vapor would have to be vented to prevent over-cooling.

Any potential over-cooling problems during a filling necessitated not during hydrocooling are remedied by positioning the bypass line connection to the vapor conduit between the first valve assembly and the distributor conduit. If the compartment temperature falls below the minimum temperature, the vent valve opens, thereby venting the excess coolant vapor and avoiding the over-cooling. It will be understood that the limitation of flow rate of the vaporized coolant liquid to 200 CFH by the flow meter 72 will not result in the release of a substantial part of the coolant liquid into the compartment during the filling operation.

The embodiment shown and described above is only exemplary. I do not claim to have invented all the parts, elements or steps described. Various modifications can be made in the construction, material, arrangement, and operation, and still be within the scope of my invention.

The limits of the invention and the bounds of the patent protection are measured by and defined in the following claims. The restrictive description and drawing of the specific example above do not point out what an infringement of this patent would be, but are to enable the reader to make and use the invention.

As an aid to correlating the terms of the claims to the exemplary drawing, the following catalog of elements is provided:

| | | | |
|---|---|---|---|
| 10 | container | 68 | liquid return manifold |
| 12 | compartment | 70 | liquid return line |
| 13 | frame | 72 | flow meter |
| 14 | wheels | 74 | releasing valve |
| 15 | fifth wheel | 76 | venturi |
| 16 | tractor | 78 | venturi inlet |
| 18 | floor | 80 | throat |
| 20 | front wall | 82 | venturi outlet |
| 22 | roof | 84 | partition |
| 24 | side walls | 85 | plenum |
| 26 | rear doors | 86 | ports |
| 28 | cryogenic tanks | 88 | duct |
| 30 | vapor header | 90 | hole |
| 32 | vapor supply line | 92 | filter |
| 34 | vapor supply manifold | 94 | relief valve |
| 36 | vapor exchange lines | 96 | liquid level gauge |
| 38 | vapor return manifold | 98 | pressure gauge |
| 40 | vapor return line | 100 | gauge line |
| 42 | distributor conduit | 102 | coolant fill line |
| 44 | pressure regulator | 104 | fill valve |
| 46 | rupture disk | 106 | by pass line |
| 48 | flow valve | 108 | by pass valve |
| 50 | vent conduit | 109 | vent-fill group |
| 52 | vent valve | 110 | controller |
| 54 | vent group | 112 | temperature sensor |
| 56 | distributor group | 114 | temperature sensor |
| 58 | gauge group | 116 | thermometer |
| 60 | liquid header | 118 | DC battery |
| 62 | liquid supply line | 119 | voltmeter |
| 64 | liquid supply manifold | 120 | ceiling pan |
| 66 | liquid vaporizer line | 122 | hydrocooling duct |

I claim as my invention:

1. A process involving a refrigeration container having a. an insulated compartment having a compartment temperature, b. at least one cryogenic tank in the compartment, c. cryogenic fluid coolant in the liquid and vapor states in the cryogenic tank, d. a vapor conduit fluidly connected to the coolant vapor in the tank, e. a liquid conduit fluidly connected to the coolant liquid in the tank;

wherein the improved method of refrigerating the container comprises the following steps in combination with the above:

f. selecting a minimum temperature such that when the compartment temperature is below the minimum temperature, no cooling of the compartment is desired, g. selecting a maximum temperature that is higher than the minimum temperature, then h. sensing the compartment temperature, i. comparing the compartment temperature with the minimum and maximum temperatures, and then j. venting excess coolant vapor from the vapor conduit to outside the compartment when the compartment temperature is below the minimum temperature, and k. flowing coolant vapor from the vapor conduit into the compartment when the compartment temperature is above the minimum temperature and below the maximum temperature, and l. vaporizing the coolant liquid in a vaporization section of the liquid conduit, and m. releasing the vaporized coolant liquid into the compartment when the compartment temperature is above the maximum temperature.

2. A process involving a refrigeration container having a. an insulated compartment having a compartment temperature, b. at least one cryogenic tank in the compartment, c. cryogenic fluid coolant in the liquid and vapor states in the cryogenic tank, d. a vapor conduit fluidly connected to the coolant vapor in the tank, e. a pressure regulator in the vapor conduit for maintaining a regulator pressure in the tank, f. a liquid conduit fluidly connected to the coolant liquid in the tank;

wherein the improved method of refrigerating the container comprises the following steps in combination with the above:

g. selecting a minimum temperature such that when the compartment temperature is below the minimum temperature, no cooling of the compartment is desired, h. setting a lower setpoint on a controller corresponding to the minimum temperature, i. selecting a maximum temperature that is higher than the minimum temperature, j. setting an upper setpoint on the controller corresponding to the maximum temperature, then k. sensing the compartment temperature, then l. varying a control point on the controller with respect to the setpoints responsive to sensed changes in the compartment temperature, then m. venting excess coolant vapor from the vapor conduit to outside the compartment responsive to the control point being below the lower setpoint by n. opening a first valve in the vapor conduit to outside the compartment, and
o. circulating gases within the compartment and cooling the compartment by either
p. flowing excess coolant vapor from the vapor conduit into the compartment responsive to the control point being between the lower and upper setpoints by
q. closing the first valve and a second valve in the liquid conduit so that the vapor conduit is fluidly connected to a venturi device having inlet and outlet ends fluidly connected to inside the compartment, thus
r. discharging the coolant vapor into the venturi device and out of the outlet end into the comparment, and thereby
s. inducing flow of gases from the compartment into the inlet end, through the venturi device, out of the outlet end, and into the compartment, or
t. vaporizing coolant liquid in a vaporization section of the liquid conduit, thus
u. releasing the vaporized coolant from the liquid conduit into the compartment responsive to the control point being above the upper setpoint by
v. opening the second valve so that the liquid conduit is fluidly connected to the venturi device through the vaporization section,
w. discharging the vaporized coolant into the venturi device and out of the outlet end into the compartment, and thereby
x. inducing flow of gases from the compartment into the inlet end, through the venturi tube, out of the outlet end, and into the compartment.

3. A process involving a refrigeration container having
a. an insulated compartment having a compartment temperature,
b. at least one cryogenic tank in the compartment,
c. cryogenic fluid coolant in the liquid and vapor state in the cryogenic tank,
d. a vapor conduit fluidly connected to the coolant vapor in the tank,
e. a liquid conduit fluidly connected to the coolant liquid in the tank,
f. a fill conduit fluidly connected to the tank and connectible to a source of coolant liquid;

wherein the improved method of refrigerating a container comprises the following steps in combination with the above:
g. releasing coolant fluid from a supply selected from the group consisting of
(i) the vapor conduit and
(ii) vaporized coolant liquid within the liquid conduit
(iii) to a venturi within the compartment,
h. discharging the coolant fluid into a throat of the venturi and out of an outlet end thereof into the compartment, thereby
j. inducing substantial flow of gases within the compartment into an inlet of the venturi, through the throat and out of the outlet of the venturi into the compartment, thereby
k. circulating the compartment gases through said venturi, and maintaining a substantially uniform compartment temperature.

4. The invention as defined in claim 3 including all of the limitations a. through k. with the addition of the following limitations:
l. connecting a source of coolant liquid having a pressure substantially greater than a pressure in the cryogenic tank to the fill line,
m. flowing the coolant liquid from the source into the cryogenic tank through the fill line,
n. depressurizing the coolant liquid in the cryogenic tank,
o. vaporizing a substantial volume of coolant liquid in the cryogenic tank,
p. opening a by pass line fluidly connecting the vapor conduit to inside the compartment, then
q. releasing the coolant vapor from the tank through the liquid conduit to the venturi and to the inside the compartment through the by pass line while discharging a portion of the coolant vapor through the venturi, thereby
r. releasing additional coolant vapor into the compartment during the circulating step.

5. On a refrigerated container having
a. an insulated compartment having a compartment temperature,
b. at least one cryogenic tank in the compartment,
c. cryogenic fluid coolant in the liquid and vapor states in the cryogenic tank,
d. a vapor conduit connected at a tank end thereof through a top of the tank to the coolant vapor,
e. a pressure regulator in the vapor conduit for maintaining a maximum pressure in the tank,
f. a liquid conduit connected at a tank end thereof through a bottom of the tank to the coolant liquid;

wherein the improved temperature control system for refrigerating the container comprises in combination with the above:
g. a outlet end of the vapor conduit opposite the tank end thereof being fluidly connected to inside the compartment,
h. an outlet end of the liquid conduit opposite the tank end thereof being fluidly connected to inside the compartment,
j. a first valve assembly in the vapor conduit,
k. a vent conduit connecting the first valve assembly with atmosphere outside the compartment,
l. the first valve assembly having a vent position and a flow position, such that
(i) when the first valve assembly is in the vent position, coolant vapor flows from the vapor conduit, through the first valve assembly, and through the vent conduit to the atmosphere, and
(ii) when the first valve assembly is in the flow position, coolant vapor flows through the first valve assembly and the vapor conduit into the compartment,
m. a second valve assembly in the liquid conduit,
n. the second valve assembly having an open position and a closed position such that
(i) when the second valve assembly is in the open position, coolant liquid flows from the tank, through the liquid conduit into the compartment, and
(ii) when the second valve assembly is in the closed position, coolant liquid does not substantially flow through the liquid conduit,
o. a temperature sensor in the compartment connected to a controller for providing a sensor input to the controller corresponding to the compartment temperature,
p. the controller being connected to the first and second valve assemblies, q. the controller having
(i) a preset lower setpoint,
(ii) a preset upper setpoint, and
(iii) a control point that varies with respect to the setpoints responsive to changes in sensor input corresponding to variance of the compartment temperature, r. said preset lower setpoint corresponding to a minimum temperature of the compartment below which no cooling of the compartment is desired, and s. said preset upper setpoint corresponding to a maximum temperature of the compartment above which cooling of the compartment with coolant liquid flow is required, t. said controller providing means for
(i) switching the first valve assembly to the vent position responsive to the control point being varied below the lower setpoint,
(ii) switching the first valve assembly to the flow position and switching the second valve assembly to the closed position responsive to the control point being varied between the lower setpoint and the upper setpoint, and
(iii) switching the second valve assembly to the open position responsive to the control point being varied above the upper setpoint.

6. The invention as defined in claim 5 including all of the limitations a. through t. with the addition of the following limitations:

u. a distributor in the compartment fluidly connecting the outlet ends of the vapor and liquid conduits to inside the compartment, v. the distributor including a venturi, w. said venturi having
(i) an inlet fluidly connected to inside the compartment,
(ii) an outlet fluidly connected to inside the compartment, and
(iii) a throat between the outlet and inlet, x. a distributor conduit connecting the outlet ends of the vapor and liquid conduits to the venturi throat, y. said venturi providing means for inducing flow of the gases within the compartment in the venturi inlet, through the throat and out the venturi outlet into the compartment when the coolant is released into the throat and out the venturi outlet, z. said compartment having a floor and a partition substantially segregating the tanks from a portion of the compartment, aa. said distributor also including
(i) a plenum forming the connection of the venturi outlet end to inside the compartment, and
(ii) a duct forming the connection of the venturi inlet end to inside the compartment, bb. said plenum extending from the venturi outlet to ports in the partition proximate the compartment floor, cc. said duct extending from the venturi inlet to a hole in the partition spaced above the compartment floor.

7. On a storage container having a. an insulated compartment having a compartment temperature, b. at least one cryogenic tank in the compartment, c. cryogenic fluid coolant in the liquid and vapor states in the cryogenic tank, d. a vapor conduit connected at a tank end thereof through a top of the tank to the coolant vapor, e. a pressure regulator in the vapor conduit for maintaining a maximum pressure in the tank and in the vapor conduit between the regulator and the tank, f. a liquid conduit connected at a tank end thereof through a bottom of the tank to the coolant liquid;

wherein the improved temperature control system for the container comprises in combination with the above:

g. a outlet end of the vapor conduit opposite the tank end thereof being fluidly connected to inside the compartment, h. an outlet end of the liquid conduit opposite the tank end thereof being fluidly connected to inside the compartment, j. a vent valve connected to the liquid conduit, k. a vent conduit connected at one end to the vent valve and at another end to atmosphere outside the compartment, l. a flow valve in the vapor conduit between the connection of the vent valve to the vapor conduit and the outlet end of the vapor conduit, m. the flow valve permitting flow when pressure in the vapor conduit between the pressure regulator and the flow valve exceeds a preselected flow pressure, n. the vent valve being electrically controlled and actuated, o. a vaporizer section in the liquid conduit, p. a releasing valve in the liquid conduit between the outlet end thereof and the vaporizer section, q. a flow meter in the liquid conduit between the releasing valve and the vaporizer section, r. the flow meter providing means for reading and limiting the flo rate of vaporized coolant liquid through the liquid conduit, s. the releasing valve being electrically controllled and actuated, t. a temperature sensor in the compartment connected to a controller for providing a sensor input to the controller corresponding to the compartment temperature, u. the controller being connected to the vent and releasing valves, v. the controller having
(i) a preset lower setpoint,
(ii) a preset upper setpoint, and
(iii) a control point that varies with respect to the setpoints responsive to changes in sensor input corresponding to variance of the compartment temperature, w. said preset lower setpoint corresponding to a minimum temperature of the compartment below which no cooling of the compartment is desired, and x. said preset upper setpoint corresponding to a maximum temperature of the compartment above which cooling of the compartment with coolant liquid flow is required to lower the compartment temperature, y. said controller being electrically powered, z. wires connecting the vent valve and the releasing valve to the controller, aa. a battery on the container connected by wires to the controller, the vent valve, and the releasing valve, bb. said controller providing means for (i) switching the vent valve to a vent position so that coolant vapor flows through the vent conduit to the atmosphere when the control point is varied below the lower setpoint, (ii) switching the vent valve to a flow position so that coolant vapor flows through the pressure valve and vapor conduit to the compartment and switching the releasing valve to a closed position so that coolant liquid does not flow through the liquid conduit when the control point is varied between the lower setpoint and the upper setpoint, and (iii) switching the releasing valve to an open position so that the coolant liquid flows through the liquid conduit, vaporizes in the vaporizer section, and flows through the flow meter, releasing valve, and venturi into the compartment when the control point is varied above the upper setpoint, cc. a distributor in the compartment fluidly connecting the outlet ends of the vapor and liquid conduits to inside the compartment, dd. the distributor including a venturi, ee. said venturi having (i) an inlet fluidly connected to the inside the compartment, (ii) an outlet fluidly connected to inside the compartment, and (iii) a throat between the outlet and inlet, ff. a distributor conduit connecting the outlet ends of the vapor and liquid conduits to the venturi throat, gg. said venturi providing means for inducing flow of the gases within the compartment in the venturi inlet through the throat and out the venturi outlet into the compartment responsive to the coolant being released into the throat and out the venturi outlet, hh. said compartment having a floor and a partition substantially segregating the tanks from a portion of the compartment, jj. said distributor also including (i) a plenum forming the connection of the venturi outlet end to inside the compartment, and (ii) a duct forming the connection of the venturi inlet end to inside the compartment, (iii) a filter and a pressure relief valve in the distributor conduit, kk. said plenum extending from the venturi outlet to ports in the partition proximate the compartment floor, ll. said duct extending from the venturi inlet to a hole in the partition spaced above the compartment floor, mm. a bypass conduit fluidly connected at an inlet end to the vapor conduit, nn. a bypass valve in the bypass conduit that is controllable from outside the compartment, oo. an outlet end of the bypass conduit extending into the plenum outside the venturi, pp. the bypass valve having (i) a closed position where the coolant vapor flows only through the venturi into the compartment, and (ii) an open position where the coolant vapor flows through the bypass conduit and the venturi into the compartment.

8. The invention as defined in claim 7 including all of the limitations a. through pp. with the addition of the following limitation:

qq. said vent and releasing valves being "MAGNALATCH" valves.

9. The invention as defined in claim 7 including all of the limitations a. through pp. with the addition of the following limitation:

qq. said venturi being a VORTEC TRANSVECTOR.

* * * * *